US007591530B2

(12) United States Patent
Gerhardt

(10) Patent No.: US 7,591,530 B2
(45) Date of Patent: Sep. 22, 2009

(54) PRINTING DEVICE

(75) Inventor: Thomas Gerhardt, Berlin (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 379 days.

(21) Appl. No.: 11/370,386

(22) Filed: Mar. 6, 2006

(65) Prior Publication Data

US 2006/0197800 A1 Sep. 7, 2006

(30) Foreign Application Priority Data

Mar. 4, 2005 (DE) ..... 10 2005 011 360

(51) Int. Cl.
*B41J 2/165* (2006.01)

(52) U.S. Cl. ..... 347/31; 347/35; 347/36

(58) Field of Classification Search ..... 347/31, 347/29, 30, 32, 35, 36
See application file for complete search history.

(56) References Cited

U.S. PATENT DOCUMENTS 4,919,715 A * 4/1990 Smith et al. ..... 75/423
5,189,442 A * 2/1993 Herbert ..... 347/2
5,956,053 A 9/1999 Michael
2004/0056919 A1 * 3/2004 Gaston et al.

FOREIGN PATENT DOCUMENTS

JP 60-224550 11/1985

* cited by examiner

*Primary Examiner*—Shih-Wen Hsieh
(74) *Attorney, Agent, or Firm*—Laurence A. Greenberg; Werner H. Stemer; Ralph E. Locher

(57) ABSTRACT

A printing device has a printer head that contains a first device for applying the ink onto a substrate. The first device includes ink nozzles for applying the ink. A second device is provided for moving the printer head from its home position into a working area and back. A waste ink container is placed in the home position of the printer head and opposite of the ink nozzles in the home position of the printer head and the waste ink container contains an open-pore absorber material. The absorber material bears a hygroscopic material on its interior and/or exterior surfaces.

16 Claims, 1 Drawing Sheet

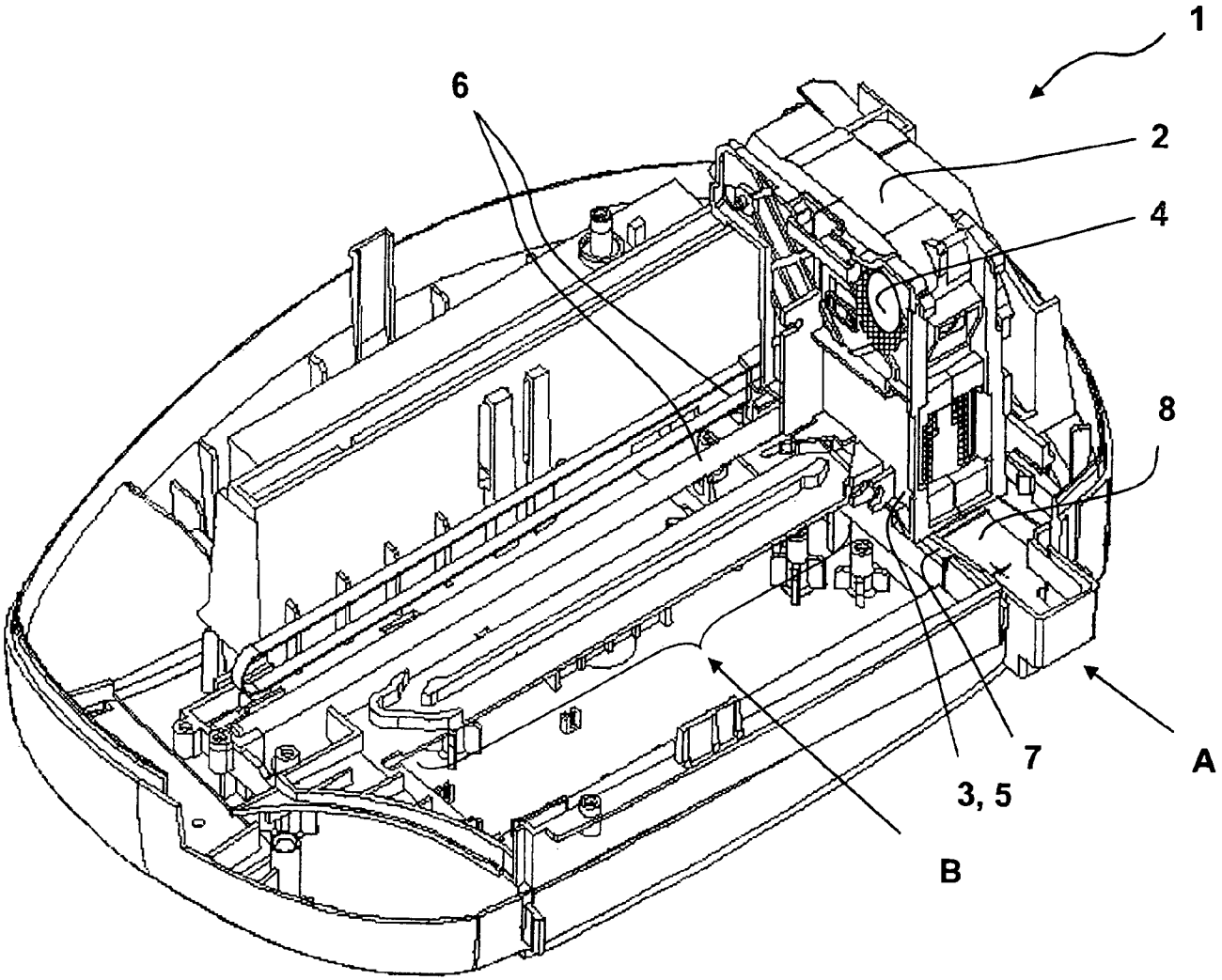
1
2
4
8
A
7
3, 5
B
6

PRINTING DEVICE

BACKGROUND OF THE INVENTION

Field of the Invention

The invention relates to a printing device with a printer head that is equipped with a device to apply ink onto a substrate. The device for applying the ink includes ink nozzles. A further device is provided for moving the printer head from a home position into an operation area and back. Finally, a waste ink container is placed directly opposite in the home position of the printer head and the ink nozzles in the home position of the printer head. Further, the invention relates to a franking machine equipped with such a printing device, the use of such a printing device and a process for the production of the printing device.

Printing devices of the type described above include ink jet printers, in particular. An electrical control signal is used to spray ink out of the ink nozzles onto the substrate such as paper, for example. Typically, multiple ink nozzles are positioned orthogonally to the process direction of the printer head. This is how a line containing characters and other symbols can be applied onto the paper through the movement of the printer head.

A problem that occurs with ink jet printers is the danger of the ink drying up in the ink nozzles. This may result in the ink nozzles becoming clogged up and, consequently, in a failure of individual ink nozzles leading to an incomplete and defective printout, if operation is continued.

In the case of ink jet printers of the type used in franking machines, the substrate such as an envelope, for example, is mostly positioned in the horizontal direction, i.e. the printer head with its ink nozzles showing downwards in a vertical direction. Managing the problem of the ink drying up at the ink nozzles is generally achieved by the printer head moving back into its home position, if no electrical signals for controlling the pressure are available. The home position may include a striper lip for cleaning the ink nozzle section, for example, is fixed at or near an edge of a waste ink container described below. Apart from this, in most cases a certain amount of ink will be ejected out of the nozzles (immediately before passing over the striper lip). This mechanism is also used to "blow free" the ink nozzles. As a result, waste ink is generated in the area of the home position. The waste ink is collected in a waste ink container. The waste ink container is either exchanged regularly or emptied. It is known from practical experience to fill the ink jet container with an open-pore absorber material such as a polymer plastic foam material. The material absorbs the waste ink and holds it inside the pores of the plastic foam material. With this method it can be assured that no more waste ink can flow out of the waste ink container which may otherwise occur during transportation of the printing device, in particular. With a view to maintenance intervals to be as long as possible, it would be desirable if the absorber material of the waste ink container would be capable of absorbing a high volume of waste ink. The problem associated therewith is that the waste ink volume would always stay drastically below the theoretical maximum absorption capacity of the absorber material. Theoretical absorber capacities mostly range between 90 volume % until almost 100 volume % of ink, related to the volume of the absorber material, i.e. 1 ml of absorber material is able to absorb just under 1 ml of ink which corresponds to an almost 100 volume % of absorbance. However, in most practical applications, less than 50 volume % and even less than 30 volume % are being achieved. The reason for this is that the waste ink may dry up on the outer surface of the absorber material and in a layer adjacent to the surface of the absorber material and that consequently it is difficult for the following waste ink to penetrate the dried waste ink layer. The top or outermost pores of the absorber material will get clogged up as well and become clotted. This will lead to relatively short maintenance intervals. Alternatively, an oversized waste ink container could be used. However, this would be negative because of cost reasons and for reasons of comfort. Reduced comfort also contradicts to the constant claim towards miniaturization of the printing devices.

SUMMARY OF THE INVENTION

It is accordingly an object of the invention to provide a printing device which overcomes the above-mentioned disadvantages of the prior art devices of this general type. The invention therefore bears the technical problem to specify a printing device that offers a waste ink container that is able to accommodate large volumes of waste ink and that allows for a small configuration at the same time.

With the foregoing and other objects in view there is provided, in accordance with the invention, a printing device. The printing device contains a printer head having a first device for applying ink onto a substrate. The first device for applying the ink has ink nozzles. A second device is provided for transporting the printer head from a home position into an operation area and back. A waste ink container is positioned in the home position of the printer head and opposite of the ink nozzles in the home position of the printer head. The waste ink container contains an open-pore absorber material, the absorber material has inner and outer surfaces and a hygroscopic material disposed on the inner and/or outer surfaces.

In order to solve this technical problem the invention teaches that the absorber material bears a hygroscopic material on its interior and/or exterior surfaces. The invention is based upon the conclusion, without being bound by theory, that the hygroscopic material absorbs water from the ambient air and/or from the waste ink which is then diluted into a solution the vapor pressure of which being considerably higher than that of pure water or of ink. Therefore, the evaporation either no longer occurs at all or occurs much slower and that any waste ink that gets in contact with the absorber material is absorbed by this solution preventing it from drying up. The drying up procedure will at least be slowed down. As a result, there is no more clogging of absorber material pores near the surface and the waste ink is absorbed by the entire volume of the absorber material. The outer surfaces of the absorber material are specified as surfaces that become visible when looking at them. The inner surfaces are being created by the interior surfaces of the pores.

When stored in normal air that always contains vapor, hygroscopic materials tend to attract moisture and to dilute continuously and, when solid materials are concerned, become fluid. Hygroscopicity is available chiefly in salts that dissolve very easily in water. Their saturated solutions show a very low vapor pressure due to their high concentration of salt. That is why the vapor condensates on the salt thereby creating a saturated solution which results in the salt becoming fluid. The same is true when aqueous waste ink gets in contact with the salt. In case of the waste ink, an ink solution is ultimately created which is being saturated with the hygroscopic material or becomes almost saturated and therefore shows an increased vapor pressure. Drying will be much slower at a defined temperature that may be ambient temperature, like 20° C., for example. The hygroscopic material preferably is an inorganic compound. This may be a hydroxide, halide (for example fluoride, chloride or bromide) sulfate, carbonate or oxide of an element of groups 1a, 1b, 2a and 2b of the periodic system, in particular. Examples of such elements: lithium, sodium, potassium, magnesium, calcium, barium, copper and zinc. Generally, the other elements of the aforementioned group of the periodic system are also suitable, however, they may not be the preferred elements for cost reasons. The inorganic salt, which may be hydrated, may be selected from the group of LiOH, NaOH, KOH, $CaCl_2$, $CaCl_2*2H_2O$, $K_2CO_2$, $MgSO_4$, $CaBr_2$, $ZnCl_2$, $ZnBr_2$ or mixtures of 2 or more such substances.

The use of $CaCl_2$ is preferred, in particular in form of dihydrate. Apart from such inorganic compounds, also hygroscopic organic salts such as acetate or lactate or organic compounds may be used. Examples are lithium acetate, sodium acetate, lithium lactate and sodium lactate. Glycerine is another compound that can be used.

The absorber material can basically be any type of absorber material that is commonly used for ink jet printers. Polymer foams or fleece materials with synthetic and/or natural organic fleece fibers can be used. A preferred polymer foam is made of PU (polyurethane) or is a viscose foam. Cellulose fleece is a preferred material for fleece. The following commercial absorber materials could be used: Spontex© Blue (from W. Dimer GmbH, Germany), Dimer© A120 (from W.Dimer GmbH, Germany) and O-Cel-O® (from 3M, Germany). It is non-critical for the invention which absorber material will be used in the end.

The relation of the weight of the hygroscopic material in the dry and/or dehydrated condition to the volume of the absorber material preferably ranges between 0.005 g/ml and 0.5 g/ml, and in particular in the range between 0.05 g/ml and 0.25 g/ml.

The invention renders a considerable synergetic effect, by the way. On the one hand, the waste ink can freely penetrate the absorber material and is able to almost completely fill the entire pore volume, the result of which is that the dimensions of the waste ink container could be very small while still offering the same absorption capacity. On the other hand, otherwise combustible absorber material becomes inflammable. Hygroscopic salts are characterized by the fact that they inhibit or at least reduce inflammability or combustibility of otherwise combustible materials. This is due to the fact that due to the hygroscopicity water will be bound and held which will be released in a retarded manner in case of fire and in case of very high temperatures associated with it due to the lowering of the vapor pressure that ultimately leads to an inhibitory effect on fire. Apart from improved absorption during operation, this will also lead to increased safety.

The invention further relates to a franking machine with a printing device in accordance with the invention. Such a franking machine contains a device for receiving a franking substrate to be franked, the printing device described above, and a device for controlling the printing device and thereby printing a franking print onto the substrate. The device for receiving a franking substrate, the printing device and the device for controlling the printing device are incorporated into a franking machine housing. The substrate is positioned by the device for receiving in a defined manner relative to the printing device to receive the franking print upon activation of the printing device by the device for controlling the printing device.

The invention further relates to a method for producing a franking print on a substrate, wherein a substrate is inserted into the device for receiving the franking substrate of a franking machine as described above, wherein the device for controlling the printing device are activated and wherein the printing device prints a franking print onto the substrate upon the activation. The substrate may be a mail object and/or a sticker for mail objects.

The invention further relates to a process for making a printing device according to the invention, wherein before, during, or after assembly of other components of the printing device the absorber material is soaked with solution of the hygroscopic material and the soaked absorber material is subjected to a drying procedure and/or pressing out procedure, and the absorber material is then inserted into the waste ink container. The drying or pressing out procedure helps to make the majority of the pore volume of the absorber material available for absorbing the waste ink. In case of the pressing out procedure, 10-99 volume %, and in particular 80-97 volume % of the solution volume absorbed during the soaking procedure and can be pressed out again. Drying can take place at 30° C. to 100° C., and in particular, at 50° C. to 80° C. The hygroscopic material remains resting on the inner and/or outer surfaces of the absorber material as thin film or layer. This will typically be followed by the usual assembly procedures for completion or starting operation of the printing device.

If an inorganic salt is used as the hygroscopic material, such a solution may be 1 to 50 percent by weight aqueous salt solution. The preferred option is the use of a 5-12 percent by weight $CaCl_2$ solution where dihydrate is used. A cellulose fleece would be the preferred absorber material. All other explanations as made above regarding the printing device apply analogously for the process in accordance with the invention.

The following section explains the invention by way of examples, wherein the examples are in no way intended to limit the scope of protection. It is evident to a person skilled in the art, that a variety of other embodiments are possible without leaving the scope of the invention.

Other features which are considered as characteristic for the invention are set forth in the appended claims.

Although the invention is illustrated and described herein as embodied in a printing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

The single FIGURE of the drawing is a diagrammatic, perspective view of a printing device according to the invention.

DESCRIPTION OF THE PREFERRED EMBODIMENTS

Referring now to the single FIGURE of the drawing in detail, there is shown as a first example a printing device 1 equipped with a printer head 2 that is equipped with a device 3 for applying ink 4 onto a substrate. The device 3 for applying ink 4 contains ink nozzles 5. A further device 6 for moving the printer head 2 from its home position A into operational area B is provided. A waste ink container 7 is placed in the home position A of the printer head 2. The waste ink container 7 lies directly opposite of the ink nozzles 5 in the home position A of the printer head 2. The waste ink container 7 is equipped with an open-pore absorber material 8. The absorber material 8 has a hygroscopic material on its inner and outer surfaces that is explained in further detail in the following examples.

A second example for equipping the absorber material 8 with a hygroscopic material is now described.

A felt-type cellulose fleece with the commercial designation Dimer© A120 was used as the absorber material 8. Alternatively, a viscose foam with the commercial designation Spontex*© Blue was used.

Both absorber materials were soaked with a aqueous solution of $CaCl_2*2H_2O$ in a concentration of 10% (w/w) with a solution volume absorbed that corresponds to the volume calculated from the geometrical outer dimensions of the absorber material. In the next step, the absorber material was dried at 60° C. for more than 100 hours.

In example 3, the testing of absorption capacity is described.

Both absorber materials 8 prepared in Example 2 were put into the waste ink containers 7 of printing devices 1 of commercial franking machines. The ink used in the franking machines comes from Hewlett Packard and uses the commercial designation Spot Blue 6170. The franking machines were operated in the same constantly repeating standard cycles until overflow of ink from the waste ink container could be observed.

For the purpose of comparison, the same testing procedure was conducted again with the same absorber material, but without the hygroscopic material under otherwise identical test conditions.

In case of the absorber material 8 equipped in accordance with the invention, the number of cycles which could be conducted until overflow of the ink from the waste ink container occurred was approximately 80% higher than for absorber material which had not been equipped with hygroscopic material. There were no significant differences detected between the two absorber materials of the invention, improvement was basically the same for both of them. The result obtained is that a franking machine can be operated almost twice as long using the same waste ink container volume. Alternatively, the waste ink container 7 according to the invention can be almost half as large compared with a waste ink container without absorber material but be operated just as long.

This application claims the priority, under 35 U.S.C. § 119, of German patent applications DE 10 2005 011 360.5, filed Mar. 4, 2005; the entire disclosure of the prior application is herewith incorporated by reference.

I claim:

1. A printing device, comprising:

a printer head having a first device for applying ink onto a substrate, said first device for applying the ink having ink nozzles formed therein;

a second device for transporting said printer head from a home position into an operation area and back; and a waste ink container positioned in the home position of said printer head and opposite of said ink nozzles in the home position of said printer head, said waste ink container containing an open-pore absorber material, said absorber material having inner and outer surfaces and a hygroscopic material disposed on at least one of said inner and outer surfaces, said hygroscopic material being an inorganic compound.

2. The printing device according to claim 1, wherein said inorganic compound is selected from the group consisting of halides, sulfates, carbonates, hydroxides, and oxides of an element of groups 1a, 1b, 2a and 2b of a periodic system.

3. The printing device according to claim 1, wherein said inorganic compound is a salt selected from the group consisting of LiOH, NaOH, KOH, $CaCl_2$, $CaCl_2*2H_2O$, $K_2CO_2$, $MgSO_4$, $CaBr_2$, $ZnCl_2$, $ZnBr_2$,hydrates of the aforementioned salts, and mixtures of 2 or more of such substances.

4. The printing device according to claim 3, wherein a ratio of weight of said hygroscopic material in a dry or a dehydrated condition to a volume of said absorber material ranges between 0.005 g/ml and 0.5 g/ml.

5. The printing device according to claim 1, wherein a ratio of weight of said hygroscopic material in a dry or a dehydrated condition to a volume of said absorber material ranges between 0.005 g/ml and 0.5 g/ml.

6. The printing device according to claim 1, wherein a ratio of a weight of said hygroscopic material in a dry or a dehydrated condition to a volume of said absorber material ranges between 0.005 g/ml and 0.5 g/ml.

7. The printing device according to claim 1, wherein said absorber material is a polymer foam or a fleece with synthetic and/or natural organic fleece fibers.

8. The printing device according to claim 7, wherein said polymer foam is made of polyurethane or viscose foam.

9. The printing device according to claim 7, wherein said fleece is a cellulose fleece.

10. A franking machine, comprising:

a first device for receiving a franking substrate to be franked;

a printing device containing:

a printer head having a second device for applying ink onto a substrate, said second device for applying the ink having ink nozzles formed therein;

a third device for transporting said printer head from a home position into an operation area and back; and a waste ink container positioned in the home position of said printer head and opposite of said ink nozzles in the home position of said printer head, said waste ink container containing an open-pore absorber material, said absorber material having inner and outer surfaces and a hygroscopic material on at least one of said inner and outer surfaces "said hygroscopic material being an inorganic compound";

a fourth device for controlling said printing device and thereby printing a franking print onto the substrate;

a franking machine housing containing said first device for receiving the franking substrate, said printing device and said fourth device for controlling said printing device; and the substrate being positioned by said first device for receiving in a defined manner relative to said printing device to receive the franking print upon activation of said printing device by said fourth device for controlling said printing device.

11. A method for producing a franking print on a substrate, which comprises the steps of:

inserting the substrate into a first device of a franking machine including:

the first device for receiving a franking substrate to be franked;

a printing device containing:

a printer head having a second device for applying ink onto a substrate, said second device for applying the ink having ink nozzles formed therein;

a third device for transporting said printer head from a home position into an operation area and back; and a waste ink container positioned in the home position of said printer head and opposite of said ink nozzles in the home position of said printer head, said waste ink container containing an open-pore absorber material, said absorber material having inner and outer surfaces and a hygroscopic material on at least one of said inner and outer surfaces said hygroscopic material being an inorganic compound;

a fourth device for controlling said printing device and thereby printing a franking print onto the substrate;

a franking machine housing containing said first device for receiving the franking substrate, said printing device and said fourth device for controlling said printing device;

the substrate being positioned by said first device for receiving in a defined manner relative to said printing device to receive the franking print upon activation of said printing device by said fourth device for controlling said printing device; and activating the fourth device for controlling the printing device and the printing device printing a franking print onto the substrate upon the activation.

12. The method according to claim 11, wherein the substrate is a mail object and/or a sticker for mail objects.

13. A process for making a printing device, which comprises the steps of:

providing a printer head having a first device for applying ink onto a substrate, the first device for applying the ink having ink nozzles formed therein;

providing a second device for transporting the printer head from a home position into an operation area and back;

providing a waste ink container positioned in the home position of the printer head and opposite of the ink nozzles in the home position of the printer head, the waste ink container containing an open-pore absorber material, the absorber material having inner and outer surfaces and a hygroscopic material on at least one of the inner and outer surfaces;

before, during, or after assembly of the printing device, soaking the absorber material with a solution of the hygroscopic material;

subjecting soaked absorber material to a drying procedure and/or pressing out procedure; and subsequently inserting the absorber material into the waste ink container.

14. The process according to claim 13, which further comprises providing the solution as an aqueous solution of an inorganic salt.

15. The process according to claim 14, which further comprising forming the solution as a 1 to 50 percent by weight aqueous $CaCl_2$ solution.

16. The process according to claim 13, which further comprises forming the absorber material as a cellulose fleece.

* * * * *